US009080421B2

(12) United States Patent
Holderman et al.

(10) Patent No.: US 9,080,421 B2
(45) Date of Patent: Jul. 14, 2015

(54) MECHANICALLY ADJUSTABLE FLOW CONTROL ASSEMBLY

(75) Inventors: Luke William Holderman, Plano, TX (US); Jean-Marc Lopez, Plano, TX (US); Brad Richard Pickle, Frisco, TX (US); Frank David Kalb, Lantana, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/990,826

(22) PCT Filed: Aug. 7, 2012

(86) PCT No.: PCT/US2012/049829

§ 371 (c)(1),
(2), (4) Date: May 27, 2014

(87) PCT Pub. No.: WO2014/025338

PCT Pub. Date: Feb. 13, 2014

(65) Prior Publication Data

US 2014/0251627 A1 Sep. 11, 2014

(51) Int. Cl.

| | |
|---|---|
| ***E21B 34/14*** | (2006.01) |
| ***E21B 43/12*** | (2006.01) |
| ***E21B 43/14*** | (2006.01) |

(52) U.S. Cl.

CPC ..... *E21B 34/14* (2013.01); *E21B 43/12* (2013.01)

(58) Field of Classification Search

CPC ..... E21B 34/14; E21B 43/12; E21B 43/14

USPC ..... 166/373, 386, 320, 332.2, 332.4, 240, 166/331, 334.1

See application file for complete search history.

(56) References Cited

U.S. PATENT DOCUMENTS

| | | | | |
|---|---|---|---|---|
| 4,734,609 | A | 3/1988 | Jasmine | |
| 5,730,223 | A | 3/1998 | Restarick | |
| 5,979,558 | A | 11/1999 | Bouldin et al. | |
| 6,276,458 | B1 * | 8/2001 | Malone et al. | 166/386 |
| 6,823,936 | B2 * | 11/2004 | Wilson | 166/50 |
| 7,055,598 | B2 | 6/2006 | Ross et al. | |
| 7,258,323 | B2 * | 8/2007 | Dwivedi | 251/345 |
| 7,559,375 | B2 * | 7/2009 | Dybevik et al. | 166/316 |
| 7,708,068 | B2 | 5/2010 | Hailey, Jr. | |
| 7,775,284 | B2 | 8/2010 | Richards et al. | |
| 7,870,908 | B2 | 1/2011 | Mandrou | |
| 8,069,921 | B2 | 12/2011 | Garcia et al. | |

(Continued)

OTHER PUBLICATIONS

International Patent Application No. PCT/US2012/049829, "International Search Report and Written Opinion", mailed Feb. 27, 2013, 19 pages.

(Continued)

*Primary Examiner* — Jennifer H Gay

(74) *Attorney, Agent, or Firm* — Kilpatrick Townsend & Stockton LLP

(57) ABSTRACT

A flow control assembly can be mechanically adjusted, rotationally or translationally, inside a tubing downhole between multiple positions by an intervening tool from the surface to change resistivity to flow through the flow control assembly. The positions among which the flow control assembly can be adjusted can include a closed position, a fully open position, and positions at which fluid experiences various resistances prior to flowing to an inner area of the tubing.

9 Claims, 11 Drawing Sheets

(56) References Cited

U.S. PATENT DOCUMENTS

| | | | | |
|---|---|---|---|---|
| 8,171,999 | B2 | 5/2012 | Langeslag | |
| 8,356,669 | B2 * | 1/2013 | Holderman | 166/316 |
| 8,469,105 | B2 | 6/2013 | O'Malley et al. | |
| 8,469,107 | B2 | 6/2013 | O'Malley et al. | |
| 2002/0020534 | A1 | 2/2002 | Wilson et al. | |
| 2004/0035578 | A1 | 2/2004 | Ross et al. | |
| 2004/0035591 | A1 | 2/2004 | Echols | |
| 2007/0012458 | A1 * | 1/2007 | Jackson | 166/386 |
| 2007/0169942 | A1 * | 7/2007 | Loretz et al. | 166/373 |
| 2007/0246213 | A1 | 10/2007 | Hailey | |
| 2007/0272408 | A1 * | 11/2007 | Zazovsky et al. | 166/278 |
| 2008/0283238 | A1 * | 11/2008 | Richards et al. | 166/228 |
| 2009/0014185 | A1 * | 1/2009 | Franco et al. | 166/373 |
| 2009/0020292 | A1 * | 1/2009 | Loretz et al. | 166/373 |
| 2009/0050335 | A1 * | 2/2009 | Mandrou | 166/386 |
| 2009/0084556 | A1 | 4/2009 | Richards et al. | |
| 2011/0146975 | A1 | 6/2011 | O'Malley et al. | |
| 2011/0147006 | A1 | 6/2011 | O'Malley et al. | |
| 2012/0048561 | A1 | 3/2012 | Holderman | |
| 2012/0325500 | A1 | 12/2012 | Moen | |
| 2013/0292133 | A1 * | 11/2013 | Thompson | 166/373 |
| 2014/0262324 | A1 | 9/2014 | Greci et al. | |
| 2015/0013980 | A1 | 1/2015 | Duphorne et al. | |

OTHER PUBLICATIONS

"Baker Hughes develops packer system for openhole annular isolation", WorldOil, Oct. 8, 2009, 2 pages.

U.S. Appl. No. 13/958,188, "Non-Final Office Action", mailed Apr. 1, 2015, 8 pages.

Baker Hughes, "Equalizer Technology Improved Water Injection Profile in Deepwater", www.bakerhughes.com, 2010, 1 page.

Baker-Hughes, "Equalizer Technology Optimizes Production, Delays Water Coning in Complex Russian Field", Connexus, vol. 1, No. 1, 2010, pp. 39-41.

* cited by examiner

MECHANICALLY ADJUSTABLE FLOW CONTROL ASSEMBLY

CROSS-REFERENCE TO RELATED APPLICATIONS

This is a U.S. national phase under 35 U.S.C. 371 of International Patent Application No. PCT/US2012/049829, titled "Mechanically Adjustable Flow Control Assembly," filed Aug. 7, 2012, the entirety of which is incorporated herein by reference.

TECHNICAL FIELD OF THE INVENTION

The present invention relates generally to assemblies for controlling fluid flow in a bore in a subterranean formation and, more particularly (although not necessarily exclusively), to assemblies that are mechanically adjustable while in the bore to change resistivity to fluid flow of the assemblies.

BACKGROUND

Various devices can be installed in a well traversing a hydrocarbon-bearing subterranean formation. Some devices control the flow rate of fluid between the formation and tubing, such as production or injection. An example of these devices is a flow control device or inflow control device that can be associated with a production interval isolated by packers and that can control production of fluid by creating a pressure drop of fluid flowing through the device.

For example, a flow control device can balance production by creating a pressure drop for reducing the production of some fluids, such as those having a higher concentration of water, for some period of time.

Adjusting a flow control device to respond to changing conditions in the well and to provide desired performance can be challenging. A flow control device may be adjusted at a surface of the well prior to being positioned in the well. Further adjustments subsequent to production may be prohibitively expensive, however, because the flow control device is adjustable only by removing it from the well and performing another adjustment at the surface. Some flow control devices can be adjusted while in the well via electronic control signals. These flow control devices, however, are operated outside of the production tubing.

Flow control assemblies are desirable that can positioned at least partly in a tubing and be adjusted while in the well among multiple positions to provide desired flow control performance.

SUMMARY

Certain aspects of the present invention are directed to a flow control assembly that can be mechanically adjusted, at least one of rotationally or translationally, inside a tubing downhole between multiple positions by an intervening tool from the surface to change resistivity to flow through the flow control assembly.

One aspect relates to a flow control assembly that can be disposed with tubing in a wellbore. The flow control assembly includes a first component and a second component. The first component has a first opening. The second component can be within the tubing and can have a second opening. The second component can be mechanically adjustable while in the wellbore by an intervening tool introduced in the tubing from a surface of the wellbore. The second component can be mechanically adjustable among physical positions with respect to the first opening for changing resistivity to fluid flow through a flow path through the first opening and the second opening.

Another aspect relates to a flow control assembly that can be disposed in a wellbore. The flow control assembly can include a component and a sleeve. The component can have an opening defining a flow path. The sleeve can have a sleeve opening and can be disposed in an inner area of a tubing. The sleeve can be mechanically adjusted at least one of rotationally or translationally with respect to the component by an intervening tool in the inner area of the tubing for changing resistivity to fluid flow through the flow control assembly by changing a position of the sleeve opening with respect to the opening.

Another aspect relates to a flow control assembly that can be disposed within a wellbore. The flow control assembly includes a component, a tubing portion, and a sleeve. The component has an opening defining a flow path. The sleeve has a sleeve opening and is disposed in an inner area of the tubing portion. The sleeve is mechanically adjustable at least one of rotationally or translationally with respect to the component (i) while in the wellbore by an intervening tool introduced from the surface of the wellbore and in the inner area of the tubing portion and (ii) among a plurality of physical positions with respect to the component for changing resistivity to fluid flow through the flow control assembly by changing a position of the sleeve opening with respect to the opening.

These illustrative aspects and features are mentioned not to limit or define the invention, but to provide examples to aid understanding of the inventive concepts disclosed in this disclosure. Other aspects, advantages, and features of the present invention will become apparent after review of the entire disclosure.

DETAILED DESCRIPTION

Figure 1:
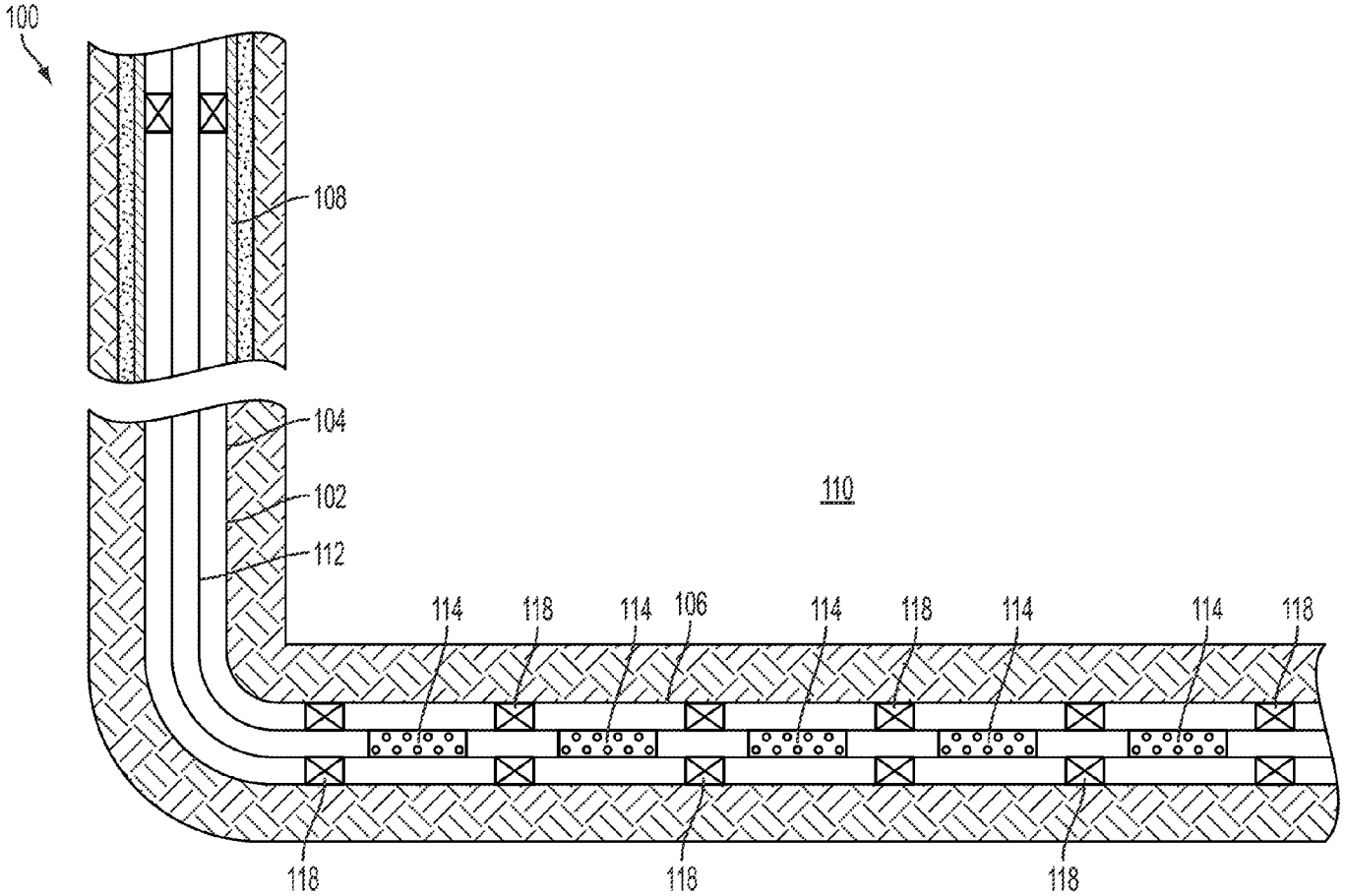
FIG. 1 is a schematic illustration of a well system having production internals in which are flow control assemblies according to one aspect of the present invention.

Certain aspects and features relate to a flow control assembly that can be mechanically adjusted inside a tubing downhole between multiple positions by an intervening tool from the surface to change resistivity to flow through the flow control assembly. The positions among which the flow control assembly can be adjusted can include a closed position, a fully open position, a position at which the fluid flow experiences a first pressure drop, a position at which the fluid flow experiences a second pressure drop, etc. A pressure drop may be the result of a flow path being partially, but not fully, open, which includes devices in the flow path or physical characteristic of the flow path causing the pressure drop. A flow control assembly according to some aspects may be or include an inflow control device and may be part of a tubing, such as a production tubing. An intervening tool may be a device positioned downhole using a slickline, electric line, coiled tubing, or other type of method of conveyance.

The flow control assembly may be mechanically adjusted by moving a component of the flow control assembly rotationally or translationally. The flow control assembly can include a sleeve with an opening. A position of the sleeve relative to another component of the flow control assembly with an opening can be mechanically adjusted rotationally or translationally using an intervening tool to change a flow path of fluid flowing through the flow control assembly, or otherwise changing the resistivity of the flow control assembly with respect to the fluid.

In some aspects, the sleeve is an inner sleeve and the other component is an outer sleeve. The inner sleeve can be rotated by the intervening tool to change the position of the inner sleeve with respect to the outer sleeve. Changing the position of the inner sleeve with respect to the outer sleeve can result in the opening of the inner sleeve changing position with respect to the opening in the outer sleeve, or otherwise changing a flow path of fluid flowing through the flow control assembly.

In one aspect, the flow control device includes a chamber between the inner sleeve and the outer sleeve. Protrusions (also referred to as "teeth") from one or both of the inner sleeve and outer sleeve can extend into the chamber. For example, protrusions can extend from the outer wall of the inner sleeve into the chamber and protrusions can extend from the inner wall of the outer sleeve into the chamber. Changing the position of the inner sleeve with respect to the outer sleeve can result in a position of the inner sleeve protrusions changing with respect to the outer sleeve protrusions, which can result in a change to the flow path of fluid flowing through the flow control assembly. For example, the protrusions, relative to each other, can result in a tortuous flow path or can result in one or more orifices that can affect fluid flow.

In other aspects or additionally, the sleeve can be adjusted translationally such that a position of the opening in the sleeve can change with respect to one or more openings in a housing defining a flow path and one or more openings in tubing. Adjusting the sleeve translationally can include moving the sleeve horizontally (or vertically as the case may be) with respect to the housing.

For example, the housing, which may be a flow restriction sub-assembly, can define a flow path in which is disposed one or more flow restrictors. A flow restrictor can restrict flow by a certain amount. An example of a flow restrictor is a choke or a valve. Changing the position of the opening in the sleeve can result in a change to the amount of restriction fluid experiences through the flow path of the housing.

In some aspects, the opening of the sleeve is a bypass channel in an outer wall of the sleeve that, when positioned, can provide a bypass channel for fluid flow around a flow blocker that can be disposed in the flow path of the housing.

A sleeve may be an at least partially circumferential structure that can be located within a tubing string or flow control assembly in a wellbore. A sleeve can be made from any suitable material. An example of suitable material is stainless steel.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

FIG. 1 depicts a well system 100 with flow control assemblies according to certain aspects of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. Production tubular sections 114 in various production intervals adjacent to the formation 110 are positioned in the tubing string 112. On each side of each production tubular section 114 is a packer 118 that can provide a fluid seal between the tubing string 112 and the wall of the wellbore 102. Each pair of adjacent packers 118 can define a production interval.

One or more of the production tubular sections 114 can include a flow control assembly. The flow control assembly can be mechanically adjusted by an intervening tool introduced into the bore from the surface to change a flow path from the subterranean formation to an internal production flow path in the tubing.

Although FIG. 1 depicts production tubular sections 114 that can include flow control assemblies positioned in the substantially horizontal section 106, production tubular sections 114 (and flow control assemblies) according to various aspects of the present invention can be located, additionally or alternatively, in the substantially vertical section 104. Furthermore, any number of production tubular sections 114 with flow control assemblies, including one, can be used in the well system 100 generally or in each production interval. In some aspects, production tubular sections 114 with flow control assemblies can be disposed in simpler wellbores, such as wellbores having only a substantially vertical section. Flow control assemblies can be disposed in open hole environments, such as is depicted in FIG. 1, or in cased wells.

Figure 2:
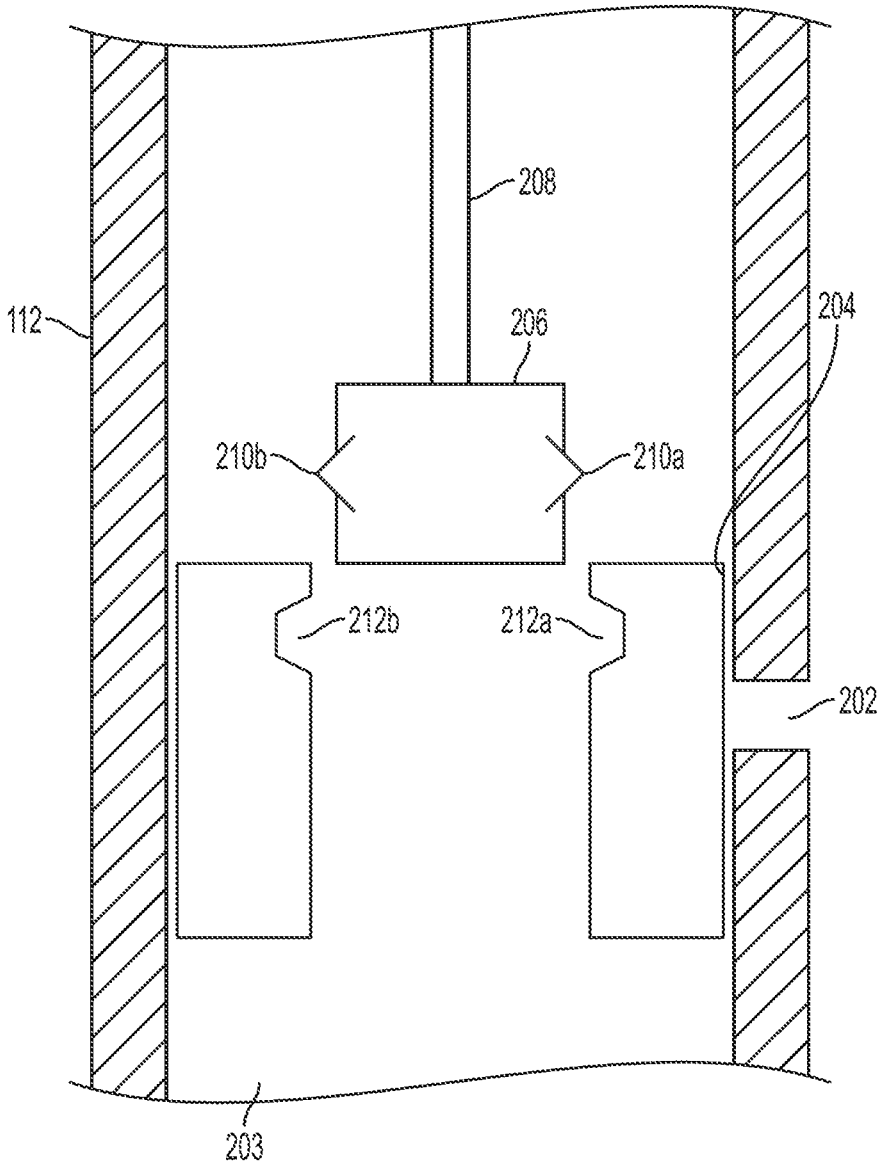
FIG. 2 is a cross-sectional view of a flow control assembly and an intervening tool in a wellbore according to one aspect of the present invention.

FIG. 2 cross-sectionally depicts part of a production interval according to one aspect. The production interval includes a tubing string 112 that has a production opening 202 through which fluid can flow from a formation. Disposed in an inner area 203 of the tubing string 112 is a flow control assembly 204, or part of a flow control assembly 204, an intervening tool 206, and a line (or lines) 208 for the intervening tool 206. The line 208 can be used to run the intervening tool 206 from the surface into the tubing string 112. The intervening tool 206 can cooperate with the flow control assembly 204 and, in response to movement of the intervening tool 206 from the surface, cause at least part of the flow control assembly 204 to change position.

The intervening tool 206 can include pins 210*a*, 210*b* or other components extending from the intervening tool 206 that can interface with slots 212*a*, 212*b* or other structures of the flow control assembly 204 to cause at least part of the flow control assembly 204 to change position. The intervening tool 206 may be a shifting tool that can cause part of the flow control assembly 204 to change position. For example, one or more of the slots 212*a*, 212*b* on an inner wall of part of the flow control assembly 204 can have a pattern such that as the intervening tool 206 is shifted downward (away from the surface), one or more pins 210*a*, 210*b* follows part of the pattern and causes at least part of the flow control assembly 204 to rotate.

Figure 3:
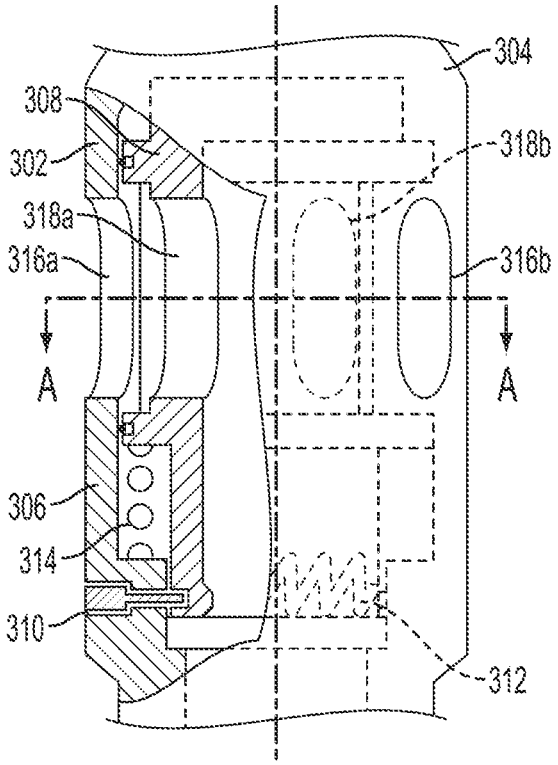
FIG. 3 is a partial cut-away view of a flow control assembly according to one aspect of the present invention.

FIG. 3 depicts a flow control assembly 302 according to one aspect. FIG. 3 depicts a cut-away view of the flow control assembly 302 on the left-hand side. On the right-hand side, FIG. 3 depicts a partial transparent view of the flow control assembly 302 via dotted lines. The flow control assembly 302 is shown disposed within a wellbore, and may be a subassembly of a tubing string. The flow control assembly 302 includes a housing 304 in which is disposed an outer sleeve 306, an inner sleeve 308, a shifting profile 312, and return spring 314. The outer sleeve 306 includes openings 316*a*, 316*b* and the inner sleeve 308 includes openings 318*a*, 318*b*.

The inner sleeve 308 can be rotationally moved or indexed such that the openings 318*a*, 318*b* in the inner sleeve 308 are positioned with respect to openings 316*a*, 316*b* in the outer sleeve 306 to provide a desired flow resistance or pressure drop. In some aspects, the inner sleeve 308 is moved clockwise by an intervening tool. For example, the inner sleeve 308 can include a profile 312 in an inner wall that can receive a pin of a J-slot mechanism through slot 310. An intervening tool can cause the inner sleeve 308 to shift downward, which results in the J-slot mechanism rotating the inner sleeve 308 with respect to the outer sleeve 306. In some aspects, the J-slot mechanism is associated with a hydraulic control line to the surface through which pressure control signals can be conveyed to the J-slot mechanism. The return spring 314 can push the inner sleeve 308 upward, returning the inner sleeve 308 to a position.

Figure 4:
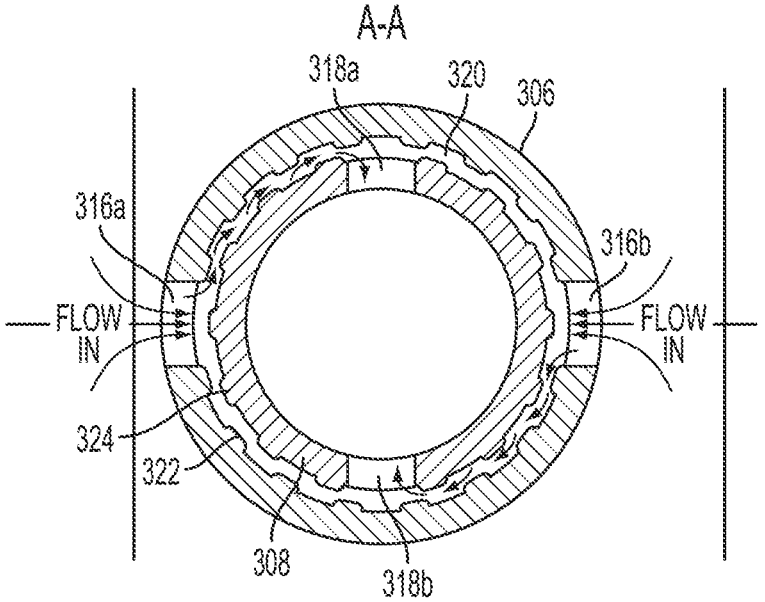
FIG. 4 is a cross-sectional view along line A-A in FIG. 3 according to one aspect of the present invention.

The outer sleeve 306 and the inner sleeve 308 can form a chamber that includes a flow path through which fluid can flow. By rotating the inner sleeve 308 with respect to the outer sleeve 306, the resistivity to fluid flow in the flow path can change. FIG. 4 depicts a cross-sectional view of part of the flow control assembly 302 along line A-A in FIG. 3 that includes the outer sleeve 306 and inner sleeve 308. A chamber 320 that includes a flow path is defined between the outer sleeve 306 and the inner sleeve 308. Fluid can flow into the flow path of the chamber 320 from openings 316*a*, 316*b* and can flow through the flow path of the chamber 320 to openings 318*a*, 318*b* that allow fluid to flow to an inner area of the tubing.

Extending from the outer sleeve 306 into the chamber are protrusions 322. Extending from the inner sleeve 308 into the chamber are protrusions 324. Protrusions 324 can cooperate with protrusions 322 to create a tortuous flow path for fluid flowing through the chamber 320, resulting in a reduced fluid velocity and creating a pressure drop by, for example, removing energy from the fluid flow. The amount of pressure drop may depend on the length of the flow path that fluid travels from openings 316*a*, 316*b* to openings 318*a*, 318*b*. Protrusions 324 can change position with respect to protrusions 322 as the inner sleeve 308 is rotated and increase or reduce the amount of pressure drop, as needed.

FIG. 4, for example, depicts fluid flow using arrows. Fluid can flow into openings 316*a*, 316*b* in the outer sleeve 306 and be directed by protrusions 322 cooperating with protrusions 324 toward one or more of openings 318*a*, 318*b* in the inner sleeve through the chamber 320. As the fluid flows toward openings 318*a*, 318*b*, the protrusions 322 and protrusions 324 can cooperate to create a tortuous flow path resulting in the fluid experiencing a pressure drop. Rotating the inner sleeve 308 with respect to the outer sleeve 306 can change the number of cooperating protrusions through which fluid flows.

Figure 5:
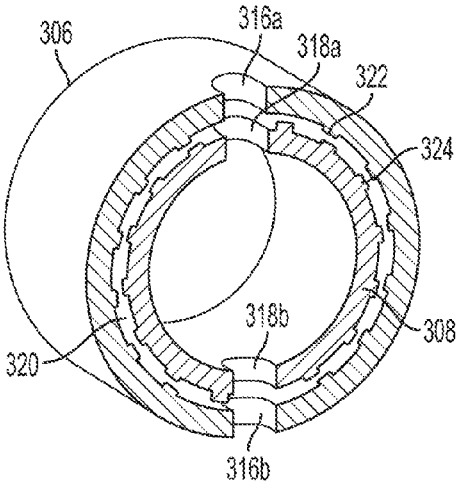
FIG. 5 is a perspective view of components of a flow control assembly in an open position according to one aspect of the present invention.
Figure 6:
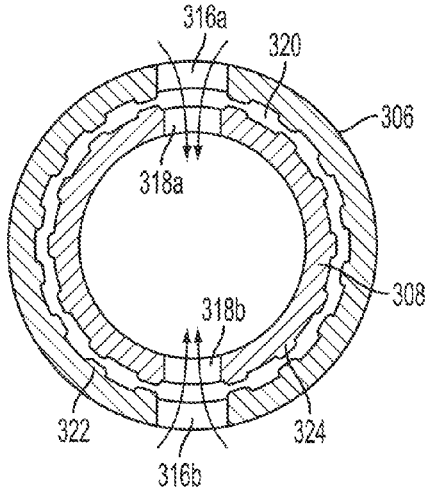
FIG. 6 is a cross-sectional view of the components of FIG. 5 according to one aspect of the present invention.

The inner sleeve 308 can be rotated with respect to the outer sleeve 306 such that fluid is substantially prevented from flowing through openings 318*a*, 318*b* or fluid is substantially allowed to flow through openings 318*a*, 318*b* without restriction by cooperating protrusions. FIGS. 5-6 depict via the inner sleeve 308 rotated with respect to the outer sleeve 306 such that fluid is substantially allowed to flow through openings 318*a*, 318*b* in the inner sleeve 306 from openings 316*a*, 316*b* in the outer sleeve 306 without flowing through chamber 320.

Figure 7:
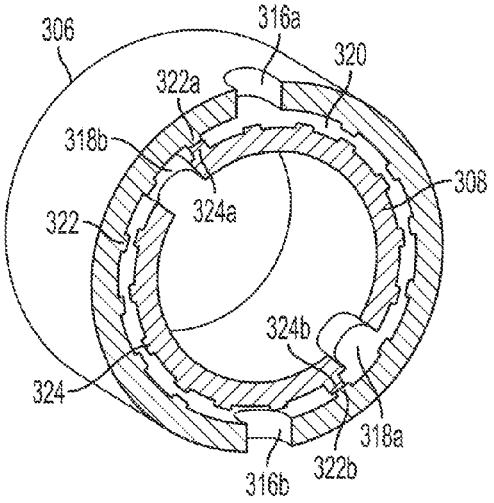
FIG. 7 is a perspective view of the components of FIG. 5 in a resistive position according to one aspect of the present invention.
Figure 8:
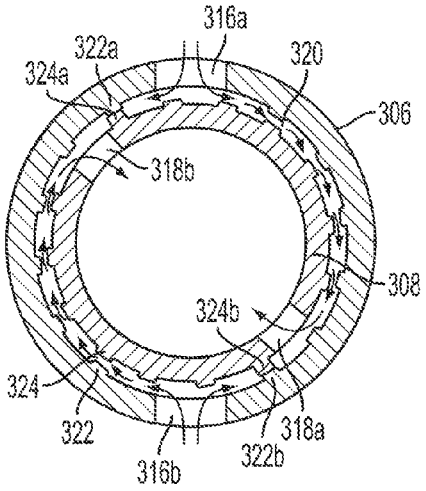
FIG. 8 is a cross-sectional view of the components of FIG. 7 according to one aspect of the present invention.

One or more protrusions of protrusions 322 and/or protrusions 324 can be configured to direct fluid in a direction within the chamber 320. For example, one protrusion of protrusions 322 or protrusion 324 can extend further into the chamber 320 than some other protrusions and cooperate, such as by aligning, with another protrusion to prevent fluid flow in one direction in the chamber 320. FIGS. 7-8 depict the inner sleeve 308 rotated with respect to outer sleeve 306 one hundred sixty degrees such that fluid flow can experience the highest flow resistance within the chamber 320 without flow being completely prevented. A protrusion 324*a* of inner sleeve 308 extends further into the chamber than at least some other protrusions 324 and can cooperate with protrusion 322*a* of the outer sleeve 306 to substantially prevent fluid from opening 316*a* from flowing in one direction in the chamber 320 and to direct fluid to flow in a second direction in the chamber 320. Protrusion 324*b* of inner sleeve 308 extends further into the chamber than at least some other protrusions 324 and can cooperate with protrusions 322*b* of the outer sleeve 306 to substantially prevent fluid from opening 316*b* from flowing in one direction in the chamber and to direct fluid to flow in a second direction in the chamber 320.

Although FIGS. 3-8 depict two openings for each of outer sleeve 306 and inner sleeve 308, any number of openings including one of each can be used. Although a position of the inner sleeve 308 with respect to the outer sleeve 306 is described with respect to FIGS. 3-8 as resulting from rotating the inner sleeve 308, certain aspects of the present invention can change a position of the inner sleeve 308 with respect to the outer sleeve 306 by rotating the outer sleeve 306 or by rotating both the outer sleeve 306 and the inner sleeve 308.

Figure 9:
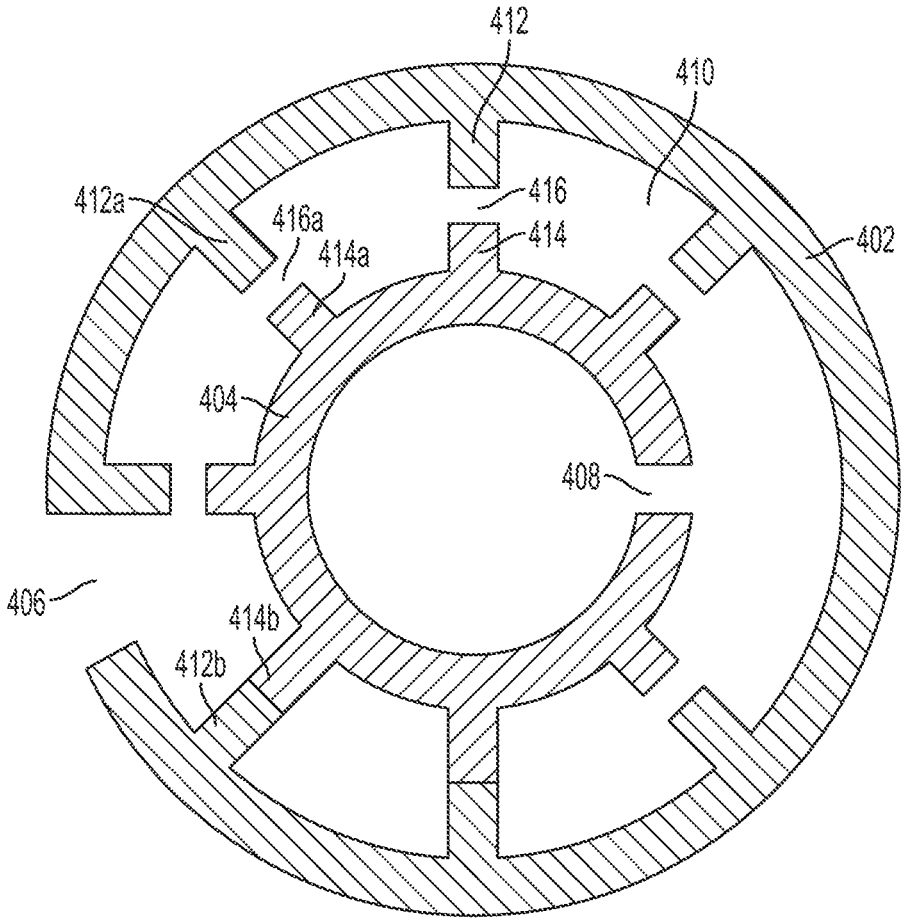
FIG. 9 is a cross-sectional view of sleeves of a flow control assembly according to one aspect of the present invention.

A flow path in a chamber of a flow control assembly according to some aspects can resist fluid flow using types of resistances in addition to or other than by using a tortuous path. FIG. 9 depicts a cross-section of part of a flow control assembly that includes an outer sleeve 402 and an inner sleeve 404 that can cooperate to create orifices for resisting fluid flow. The outer sleeve 402 includes an opening 406 through which fluid can flow into the flow control assembly. The inner sleeve 404 includes an opening 408 through which fluid can flow from a flow path in a chamber 410 defined by the outer sleeve 402 and inner sleeve 404 into an inner area of tubing string.

The outer sleeve 402 includes protrusions 412 that can align with protrusions 414 of the inner sleeve 404 to create orifices 416 through which fluid can be directed to flow, or to block fluid flow. For example, protrusion 412*a* is aligned with protrusion 414*a* to create an orifice 416*a* through which fluid flows and can be restricted. The number of orifices 416 through which fluid is caused to flow can change by rotating the inner sleeve 404 with respect to the outer sleeve 402 and changing a position of the opening 408 with respect to opening 406. Protrusion 412*b* is aligned with protrusion 414*b* to substantially block flow in one direction in the chamber 410. Protrusion 414*b* may, for example, extend further into the chamber 410 than other protrusions 414 to cooperate with one of the protrusions 412 of the outer sleeve 402 to substantially block flow in one direction.

Figure 10:
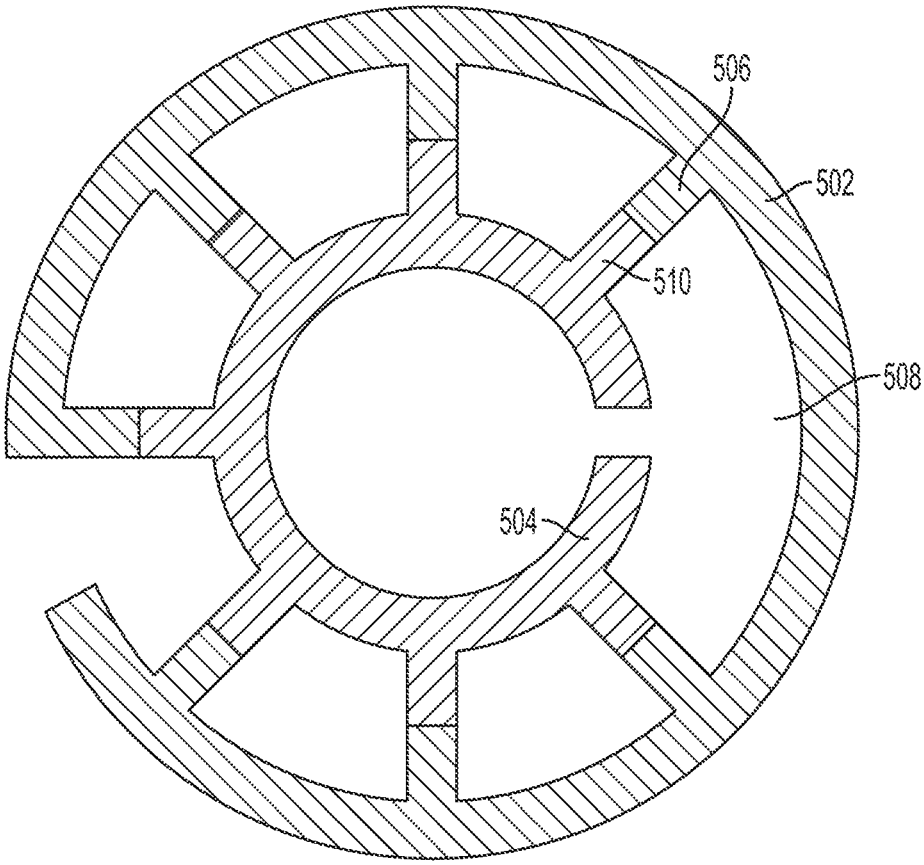
FIG. 10 is a cross-sectional view of sleeves of a flow control assembly according to another aspect of the present invention.

In other aspects, protrusions can align to substantially block fluid flow. FIG. 10 depicts a cross-section of an outer sleeve 502 and an inner sleeve 504. The outer sleeve 502 includes protrusions 506 extending into a chamber 508 and cooperating with protrusions 510 extending into the chamber 508 from inner sleeve 504 to substantially block fluid flow. In some aspects, the inner sleeve 504 can be rotated with respect to the outer sleeve 502 such that the protrusions 510 are not aligned with protrusions 506, creating a tortuous flow path through the chamber 508.

Figure 11A:
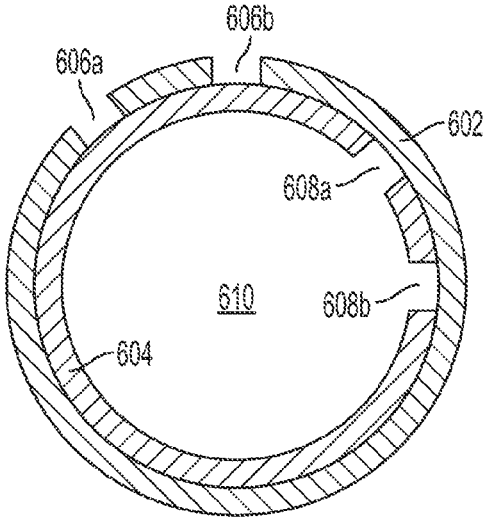
FIG. 11A is a cross-sectional view of sleeves of a flow control assembly in a closed position according to one aspect of the present invention.
Figure 11B:
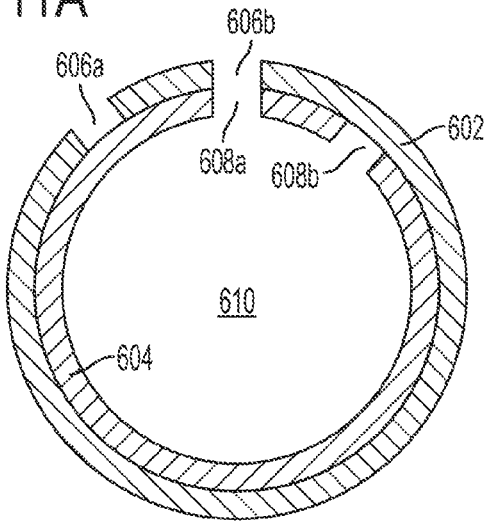
FIG. 11B is a cross-sectional view of the sleeves of FIG. 11A in a first open position according to one aspect of the present invention.
Figure 11C:
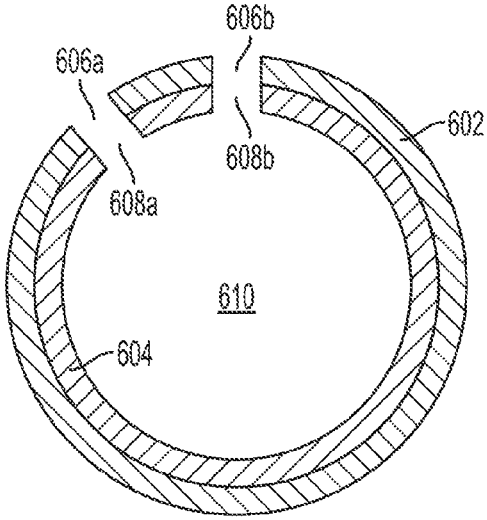
FIG. 11C is a cross-sectional view of the sleeves of FIG. 11A in a second open position according to one aspect of the present invention.
Figure 12A:
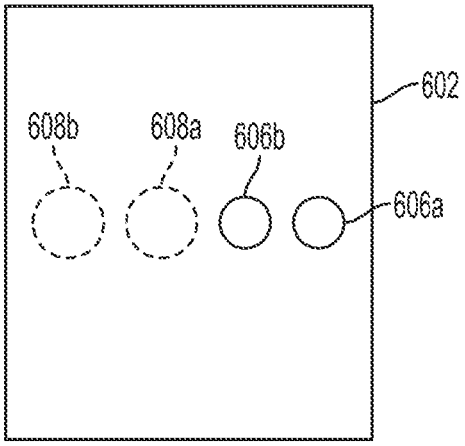
FIG. 12A is a side view of the sleeves of FIG. 11A in a closed position according to one aspect of the present invention.
Figure 12B:
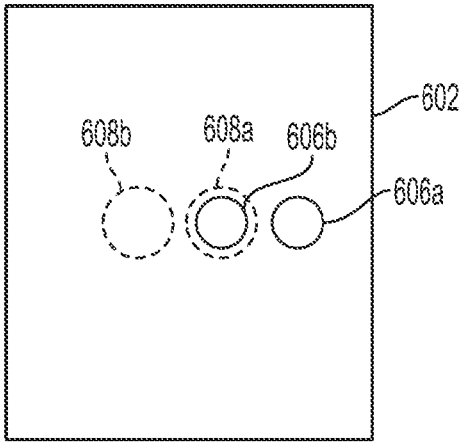
FIG. 12B is a side view of the sleeves of FIG. 11A in a first open position according to one aspect of the present invention.
Figure 12C:
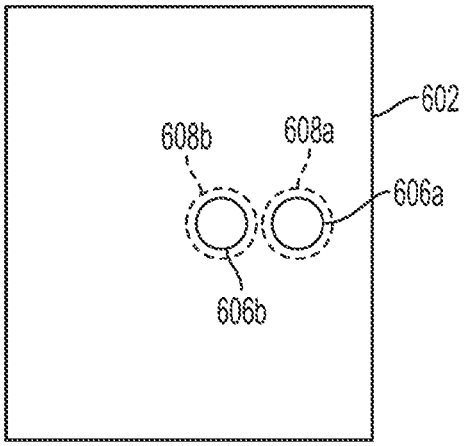
FIG. 12C is a side view of the sleeves of FIG. 11A is a second open position according to one aspect of the present invention.

In some aspects, openings in sleeves can be configured to allow an amount of resistivity of flow to change based on a position of the openings with respect to each other. FIGS. 11A-11C depict via cross-section an outer sleeve 602 and an inner sleeve 604 of a flow control assembly. FIGS. 12A-12C depict an outer wall of part of the outer sleeve 602.

The outer sleeve 602 includes openings 606*a*, 606*b* through which fluid can flow. The inner sleeve 604 includes openings 608*a*, 608*b* through which fluid can flow to an inner area 610 of a tubing string. The inner sleeve 604 can be rotated with respect to the outer sleeve 602 to change the position of openings 608*a*, 608*b* with respect to openings 606*a*, 606*b* to change resistivity to fluid flow through the flow control assembly.

In FIGS. 11A and 12A, the flow control assembly is in a closed position. None of the openings 608*a*, 608*b* are aligned with one or more of openings 606*a*, 606*b* such that fluid is prevented from flowing to the inner area 610 of the tubing string. FIGS. 12A-12C depict openings 608*a*, 608*b* using dashed lines to indicate the position of the openings 608*a*, 608*b* in the inner sleeve 604 that is disposed in an inner area defined by the outer sleeve 602. In FIGS. 11B and 12B, the inner sleeve 604 is rotated to a position such that opening 608*a* of the inner sleeve 604 substantially aligns with opening 606*b* of the outer sleeve 602, allowing fluid to flow to the inner area 610 of the tubing string while experiencing some amount of resistance due to the area of the flow path creating by opening 608*a* aligning with opening 606*b*. In FIGS. 11C and 12C, the inner sleeve 604 is rotated to an open position such that opening 608*a* of the inner sleeve 604 substantially aligns with opening 606*a* of the outer sleeve 602 and opening 608*b* substantially aligns with opening 606*b*. In an open position, fluid can be allowed to flow to the inner area 610 of the tubing string without substantial restriction, or at least with a lower or lowest amount of restriction provided by the flow control assembly.

Figure 13A:
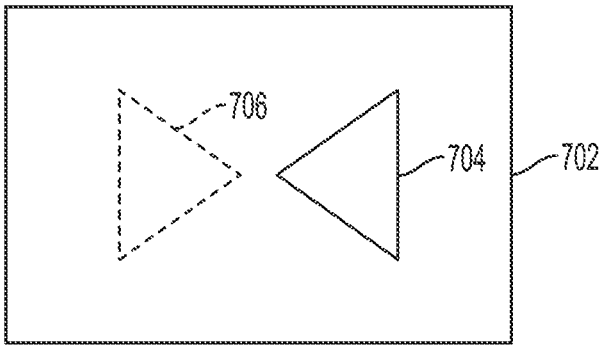
FIG. 13A is a side view of sleeves of a flow control assembly with windows in a closed position according to one aspect of the present invention.
Figure 13B:
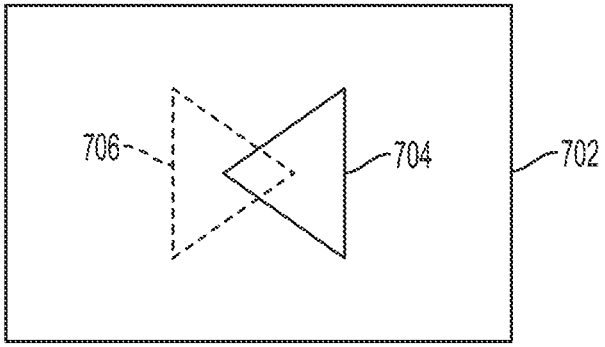
FIG. 13B is a side view of the sleeves of FIG. 13A in a first open position according to one aspect of the present invention.
Figure 13C:
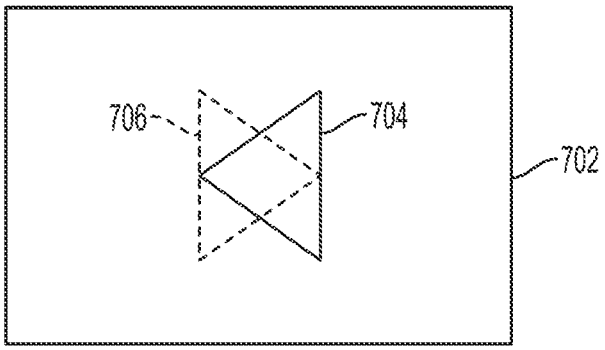
FIG. 13C is a side view of the sleeves of FIG. 13A is a second open position according to one aspect of the present invention.

In other aspects, the shape of openings can be configured such that as openings in sleeves align in response to rotation by an inner sleeve, the amount of resistivity to fluid changes. FIGS. 13A-13C depict an outer sleeve 702 of a flow control assembly in which is located an inner sleeve that can be rotated with respect to the outer sleeve 702. The outer sleeve 702 includes an opening 704 having a triangular shape as an example. The inner sleeve includes an opening 706, shown by dotted lines to indicate the location of the opening 706 of the inner sleeve in an inner area defined by the outer sleeve 702, that is triangular shaped. Although opening 704 and opening 706 are depicted as having a triangular shape, openings according to various aspects may have any suitable shape and may have different shapes.

In FIG. 13A, the flow control assembly is in a closed position as the opening 704 and the opening 706 do not align, substantially preventing fluid from flowing through the flow control assembly to an inner area of a tubing string. In FIG. 13B, the inner sleeve is rotated with respect to the outer sleeve 702 such that part of the opening 706 aligns with the opening 704, providing a flow path for fluid through the flow control assembly to the inner area of the tubing string. The flow control assembly may resist fluid flow at least partially in this first opening position, based on a size of the flow path created by the opening 706 partially aligning with the opening 704. In FIG. 13C, the opening 706 substantially aligns with the opening 704 in the outer sleeve 702 such that an area of the flow path through the opening 706 and the opening 704 is increased and fluid experiences less resistance flowing through the flow control assembly to the inner area of the tubing string.

In some aspects, part of a flow control assembly can be adjusted translationally to change resistivity of the flow control assembly to fluid flow through the flow control assembly. FIGS. 14A-14D depict via cross-section part of a flow control assembly that includes a flow restriction sub-assembly 802 and a sleeve 804. The sleeve 804 is internal to a tubing string 806 and the flow restriction sub-assembly 802 is external to the tubing string 806. The sleeve 804 includes an opening 808 and can be adjusted translationally with respect to the flow restriction sub-assembly 802 to change resistivity to fluid flow through the flow control assembly. Although sleeve 804 is depicted as including one opening 808, sleeves according to some aspects include more than one opening.

The flow restriction sub-assembly 802 includes a housing 810 defining a flow path 812 through which fluid can flow. In the flow path are disposed flow restrictors 814*a*, 814*b*. A flow restrictor can be configured in shape or otherwise to restrict fluid flow by a certain amount. An example of a flow restrictor is a choke assembly. Although FIGS. 14A-14D depict two flow restrictors, any number of flow restrictors can be used. The flow restriction sub-assembly 802 includes openings such as passages 816*a*, 816*b*, 816*c* that align with openings in the tubing string 806 to provide a flow path for fluid. Passage 816*a* may be closer to a source of fluid than the other passages and the flow restrictors 814*a*, 814*b*.

Figure 14A:
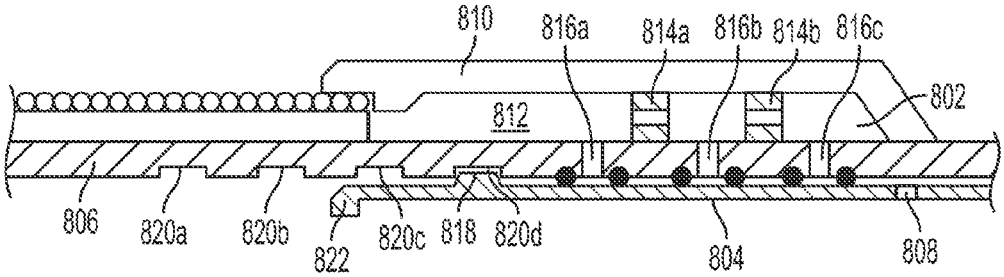
FIG. 14A is a cross-sectional side view of part of a flow control assembly in a closed position according to another aspect of the present invention.

The sleeve 804 includes a ridged portion 818 that can engage gaps 820*a*, 820*b*, 820*c*, 820*d* in an inner wall of the tubing string 806. In FIG. 14A, the ridged portion 818 engages gap 820*d* and the sleeve 804 is in a closed position. In a closed position, the opening 808 in the sleeve 804 is not aligned with any of the passages 816*a*, 816*b*, 816*c* in the flow restriction sub-assembly 802 such that fluid flow through the flow path 812 is substantially prevented from flowing through the opening 808 to an inner area of the tubing string 806.

Figure 14B:
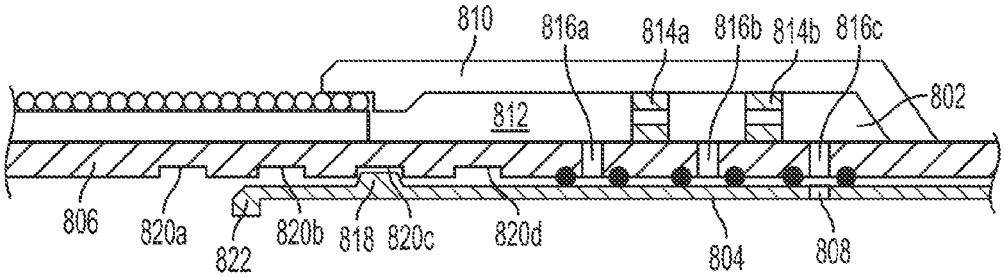
FIG. 14B is a cross-sectional side view of the flow control assembly of FIG. 14A in a first open position according to one aspect of the present invention.

The sleeve 804 can include an engagement member 822 that can engage an intervening tool in the wellbore and can allow a position of the sleeve 804 to be adjusted translationally. In FIG. 14B, the sleeve 804 is adjusted toward the surface such that the ridged portion 818 engages gap 820*c*. In this position, the opening 808 in the sleeve 804 aligns with passage 816*c* in the flow restriction sub-assembly 802 to provide a flow path for fluid from the flow path 812 in the flow restriction sub-assembly 802 to an inner area of the tubing string 806. The fluid flowing through the flow path 812 flows through flow restrictors 814*a*, 814*b* and experiences a level of restriction from both flow restrictors 814*a*, 814*b*.

Figure 14C:
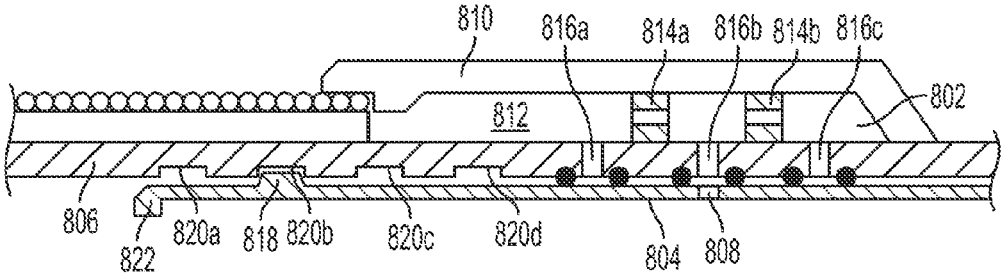
FIG. 14C is a cross-sectional side view of the flow control assembly of FIG. 14A in a second open position according to one aspect of the present invention.

In FIG. 14C, the sleeve 804 is adjusted toward the surface such that the ridged portion 818 engages gap 820*b* and the opening 808 in the sleeve 804 aligns with passage 816*b* in the flow restriction sub-assembly 802 to create a flow path for fluid to enter the inner area of tubing string 806. In this position, at least some of the fluid can flow through 808 without flowing through flow restrictor 814*b*. Fluid can flow through flow restrictor 814*a*, but experiences less resistance than in FIG. 14B because fluid is not required to flow through flow restrictor 814*b* prior to flowing through opening 808.

Figure 14D:
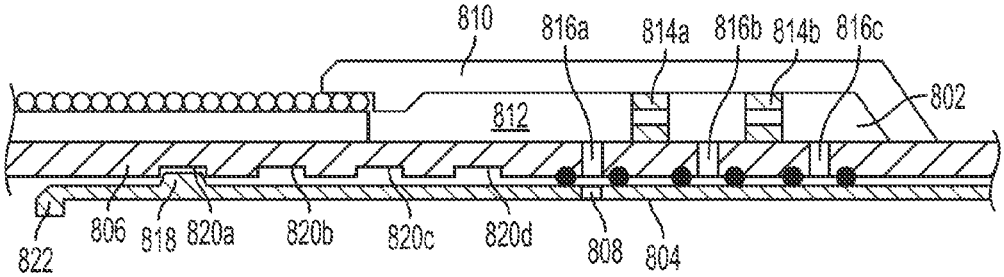
FIG. 14D is a cross-sectional side view of the flow control assembly of FIG. 14A in a third open position according to one aspect of the present invention.

In FIG. 14D, the sleeve is adjusted toward the surface such that the ridged portion 818 engages gap 820*a* and the opening 808 in the sleeve 804 aligns with passage 816*a* in the flow restriction sub-assembly 802 to create a flow path for fluid to enter the inner area of tubing string 806. This position may be a substantially open position in that fluid is not required to flow through flow restrictor 814*a* or flow restrictor 814*b* prior to flowing through opening 808 to the inner area of the tubing string.

Figure 15A:
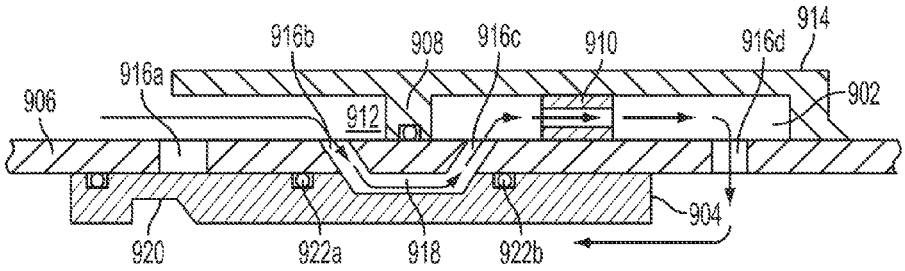
FIG. 15A is a cross-sectional side view of part of a flow control assembly in a first open position according to another aspect of the present invention.
Figure 15B:
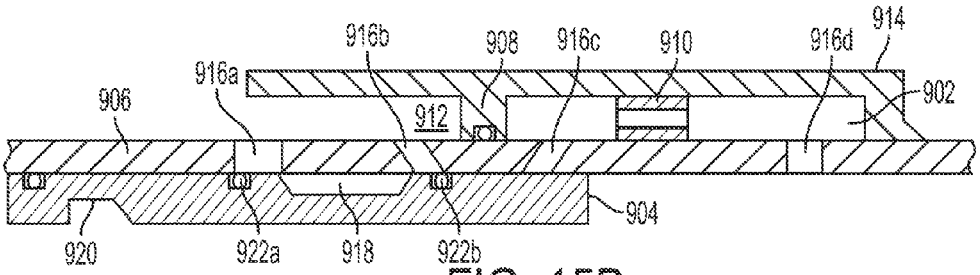
FIG. 15B is a cross-sectional side view of the flow control assembly of FIG. 15A in a closed position according to one aspect of the present invention.
Figure 15C:
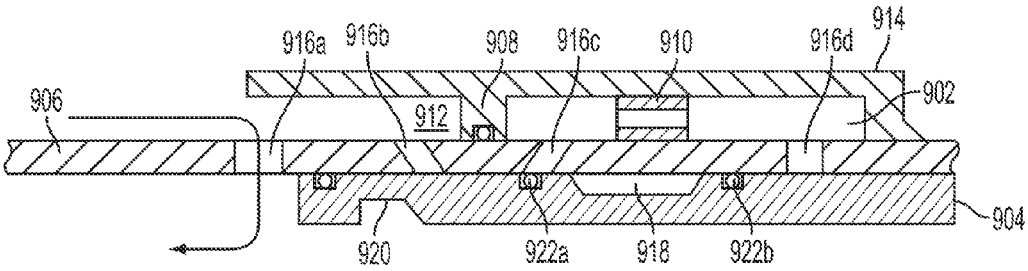
FIG. 15C is a cross-sectional side view of the flow control assembly of FIG. 15A in a second open position according to another aspect of the present invention.

FIGS. 15A-C depict part of a flow control assembly according to another aspect. The flow control assembly includes a flow restriction sub-assembly 902 disposed external to a tubing string 906 and a sleeve 904 disposed internal to the tubing string 906. The flow restriction sub-assembly 902 includes a flow blocker 908 and a flow restrictor 910 disposed in a flow path 912 defined by a housing 914 and the tubing string 906. The flow blocker 908 may substantially prevent fluid from flowing from one side of the flow blocker 908 to another side of the flow blocker 908. In some aspects, the flow blocker 908 is part of the housing 914. The flow restriction sub-assembly 902 also includes openings such as passages 916*a*, 916*b*, 916*c*, 916*d* that correspond to openings in the tubing string 906.

The sleeve 904 includes an opening that is a bypass channel 918 on an outer wall of the sleeve 904. The sleeve 904 also includes an engagement member 920 on an inner wall of the sleeve 904. The engagement member 920 can engage an intervening tool in an inner area of the tubing string to adjust a position of the sleeve 904 translationally with respect to the flow restriction sub-assembly 902 and change resistivity of the flow control assembly to fluid flow.

In FIG. 15A, the sleeve 904 is at a position such that the bypass channel 918 aligns at least partially with passages 916*b* and 916*c* to provide a bypass flow path for fluid through the flow path 912 from one side of the flow blocker 908 to another side of the flow blocker 908. The sleeve 904 is also position such that fluid flow through passage 916*a* is substantially prevented. Fluid can flow through the bypass channel 918 to the other side of the flow blocker 908, through flow restrictor 910 and through passage 916*d* to the inner area of the tubing string 906. In this position, the fluid can experience resistivity to flow from the flow restrictor 910. O-rings 922*a*, 922*b*, or other sealing mechanisms, can be included in the sleeve 904 to prevent fluid from flowing out of the bypass channel 918 except towards passage 916*c*.

In FIG. 15B, the sleeve 904 is adjusted to a position such that the bypass channel 918 does not provide a flow path for fluid to flow from one side of the flow blocker 908 to the other side of the flow blocker 908 and the sleeve 904 can substantially prevent fluid from flowing through passage 916*a* in the flow restriction sub-assembly 902. In this closed position, fluid may be substantially prevented from flowing through the flow control assembly to an inner area of the tubing string 906 by the sleeve 904 preventing flow through the passage 916*a* and the flow blocker 908 preventing flow to the other side of the flow blocker 908 that is farther from the source of the fluid.

In FIG. 15C, a position of the sleeve 904 is adjusted such that the sleeve does not prevent fluid flow through the passage 916*a* in the flow restriction sub-assembly 902 and fluid is allowed to flow through the corresponding opening in the tubing string 906 to an inner area of the tubing string without substantial restriction.

Although FIGS. 15A-15C depict a flow control assembly that includes one flow blocker 908, one flow restrictor 910, and one bypass channel 918, any number of flow blockers, flow restrictors, and bypass channels can be used.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A flow control assembly configured for being disposed with tubing in a wellbore, the flow control assembly comprising:

a first component having a first opening; and a second component within the tubing, the second component having a second opening and being rotationally adjustable (i) while in the wellbore only by an intervening tool introduced in the tubing from a surface of the wellbore to rotate the second component mechanically and (ii) among a plurality of physical positions with respect to the first opening for changing resistivity to fluid flow through a flow path through the first opening and the second opening, the flow path including a first component flow path in fluid communication with the first opening and a second component flow path in fluid communication with the second opening, wherein the second component is configured for being adjustable among the plurality of physical positions with respect to the first component for changing resistivity to fluid flow through the flow control assembly by changing a location of the second component flow path with respect to the first component flow path and changing a position of protrusions positioned in part of the flow path, wherein the first component is one of an inner sleeve or an outer sleeve and the second component is the other one of the inner sleeve or the outer sleeve.

2. The flow control assembly of claim 1, wherein the plurality of physical positions comprise:

a first position for closing the flow control assembly to fluid flow;

a second position for opening the flow control assembly to full fluid flow;

a third position for resisting fluid flow by a first pressure drop; and a fourth position for resisting fluid flow by a second pressure drop.

3. The flow control assembly of claim 1, wherein the second component is rotationally adjustable by the intervening tool among the plurality of physical positions with respect to the first opening for changing resistivity to fluid flow through the flow path by changing the flow path for fluid through the first opening and the second opening.

4. The flow control assembly of claim 1, wherein the first component is the outer sleeve and the second component is the inner sleeve, wherein the inner sleeve is rotationally and mechanically adjustable while in the wellbore by the intervening tool that is configured to rotate the inner sleeve among the plurality of physical positions with respect to the outer sleeve for changing resistivity to fluid flow through the flow path.

5. The flow control assembly of claim 4, wherein the outer sleeve comprises outer protrusions extending toward the inner sleeve from the outer sleeve into a part of the flow path between the inner sleeve and the outer sleeve, wherein the inner sleeve comprises inner protrusions extending toward the outer sleeve from the inner sleeve into the flow path between the inner sleeve and the outer sleeve, wherein the inner sleeve is mechanically adjustable among the plurality of physical positions with respect to the outer sleeve for changing resistivity to fluid flow through the flow path by changing a location of the inner protrusions relative to the outer protrusions and by changing a location of the second opening of the inner sleeve relative to the first opening of the outer sleeve.

6. The flow control assembly of claim 5, wherein at least one protrusion of the inner protrusions or the outer protrusions extends into the flow path between the inner sleeve and the outer sleeve more than at least some other protrusions of the inner protrusions and the outer protrusions, wherein the at least one protrusion is configured to align circumferentially with another protrusion of the inner protrusions or the outer protrusions for preventing fluid flow in a first direction within the flow path between the inner sleeve and the outer sleeve.

7. The flow control assembly of claim 4, wherein the intervening tool is configured to translate in the tubing for rotationally adjusting the inner sleeve with respect to the outer sleeve.

8. The flow control assembly of claim 4, wherein the inner sleeve is rotationally and mechanically adjustable while in the wellbore by the intervening tool that is configured to rotate the inner sleeve among the plurality of physical positions with respect to the outer sleeve and change a location of the second opening of the inner sleeve with respect to the first opening of the outer sleeve for changing resistivity to fluid flow through the flow path.

9. The flow control assembly of claim 8, wherein the first opening and the second opening are configured for providing an amount of resistivity to fluid flow that is based on an amount of alignment of the second opening with the first opening.

* * * * *